US010205269B2

(12) United States Patent
Hirota

(10) Patent No.: US 10,205,269 B2
(45) Date of Patent: Feb. 12, 2019

(54) WATERPROOF CONNECTOR WITH TABS EXTENDING FORWARD FROM TERMINAL BODIES WITH THEIR CENTERS AT HIGHER POSITIONS THAN THOSE OF THE TERMINAL BODIES

(71) Applicant: Sumitomo Wiring Systems, Ltd., Yokkaichi, Mie (JP)

(72) Inventor: Masanori Hirota, Mie (JP)

(73) Assignee: Sumitomo Wiring Systems, Ltd. (JP)

( * ) Notice: Subject to any disclaimer, the term of this patent is extended or adjusted under 35 U.S.C. 154(b) by 0 days.

(21) Appl. No.: 15/884,522

(22) Filed: Jan. 31, 2018

(65) Prior Publication Data

US 2018/0248302 A1 Aug. 30, 2018

(30) Foreign Application Priority Data

Feb. 1, 2017 (JP) ..... 2017-017046

(51) Int. Cl.

| | |
|---|---|
| ***H01R 13/40*** | (2006.01) |
| ***H01R 13/52*** | (2006.01) |
| ***H01R 13/04*** | (2006.01) |
| ***H01R 13/422*** | (2006.01) |

(52) U.S. Cl.

CPC ..... *H01R 13/5208* (2013.01); *H01R 13/04* (2013.01); *H01R 13/4223* (2013.01); *H01R 13/5205* (2013.01); *H01R 13/5221* (2013.01)

(58) Field of Classification Search

CPC .... H01R 13/04; H01R 13/40; H01R 13/4223; H01R 13/5205; H01R 13/5208; H01R 13/5221

USPC ..... 439/587, 588, 272–275

See application file for complete search history.

(56) References Cited

U.S. PATENT DOCUMENTS

| | | | | |
|---|---|---|---|---|
| 5,538,441 | A * | 7/1996 | Paolucci | H01R 13/5208 439/587 |
| 7,922,530 | B2 * | 4/2011 | Chazottes | H01R 13/5208 439/587 |
| 8,469,742 | B2 * | 6/2013 | Shiga | H01R 13/5208 439/587 |
| 8,562,377 | B2 * | 10/2013 | Kawamura | H01R 9/032 439/607.44 |

(Continued)

FOREIGN PATENT DOCUMENTS

| | | |
|---|---|---|
| JP | 2015-065039 | 4/2015 |

*Primary Examiner* — Chandrika Prasad
(74) *Attorney, Agent, or Firm* — Gerald E. Hespos; Michael J. Porco; Matthew T. Hespos

(57) ABSTRACT

A waterproof connector includes tabs (22) extending forward from terminal bodies (21) of male terminal fittings (20) with their centers higher than centers (21C) of the terminal bodies (21) in a height direction. A housing (10) has terminal accommodation chambers (12) for accommodating the terminal bodies (21) and connecting portions (23). A one-piece rubber plug (40) is in a rear part of the housing (10) and has seal holes (41). A rear holder (60) is behind the rubber plug (40) and has through holes (61) communicating with the seal holes (41). Inner peripheral lips (43F, 43R) on an inner periphery of each seal hole (41) closely contact an outer periphery of a wire (30) in a liquid-tight manner with the terminal body (21) and a front part (30F) of the wire (30) accommodated in the terminal accommodation chamber (12). The axes of through holes (61are lower than the axes of terminal accommodation chambers (12).

4 Claims, 7 Drawing Sheets

(56) References Cited

U.S. PATENT DOCUMENTS

2011/0290520 A1* 12/2011 Nishimura ..... H01R 13/5208
174/50.5

* cited by examiner

WATERPROOF CONNECTOR WITH TABS EXTENDING FORWARD FROM TERMINAL BODIES WITH THEIR CENTERS AT HIGHER POSITIONS THAN THOSE OF THE TERMINAL BODIES

BACKGROUND

Field of the Invention

The invention relates to a waterproof connector.

Related Art

Japanese Unexamined Patent Publication No. 2015-065039 discloses a waterproof connector with male terminal fittings fixed to end parts of coated wires and a one-piece rubber plug mounted in a rear of a housing. The rubber plug has seal holes and each male terminal fitting is mounted into a terminal accommodation chamber of the housing by being inserted through the seal hole. With the male terminal fittings mounted in the housing, the coated wires pass through the seal holes and lips formed on the inner peripheries of the seal holes closely contact the outer peripheries of the coated wires in a liquid-tight manner.

The male terminal fitting is long and narrow in a front-rear direction and has a terminal body between front and rear ends. A long narrow tab extends forward from the terminal body, and the coated wire is fixed to a wire connecting portion at the rear of the terminal body. Axial heights of the coated wire and the seal hole substantially match to ensure sealing. However, the tab is deviated vertically from the axes of the coated wire and the seal hole due to machining reasons or the like. Thus, the lips of the seal hole may deform improperly deformed due interference of the tab when the male terminal fitting is inserted through the seal hole.

The invention was completed on the basis of the above situation and aims to prevent improper deformation of lips of a seal hole due to the interference of a tab.

SUMMARY

The invention is directed to a waterproof connector with male terminal fittings that extend long in a front-rear direction. Each male terminal fitting has a terminal body. A connecting portion is connected to a rear end of the terminal body. The connecting portion is fixed to a front end part of a wire such that the terminal body is substantially coaxial with the front end part. A long narrow tab extends forward from the terminal body and is disposed at a position higher than a center position of the terminal body in a height direction. The connector also has a housing formed with terminal accommodation chambers for accommodating the terminal bodies and the connecting portions. A one-piece rubber plug is provided in a rear part of the housing and is formed with seal holes that communicate with the terminal accommodation chambers. A rear holder is disposed behind the one-piece rubber plug and is formed with through holes that communicate with the seal holes. Lips are formed on an inner periphery of the seal hole and closely contact an outer periphery of the wire in a liquid-tight manner with the terminal body and the front part of the wire accommodated in the terminal accommodation chamber. The through holes at positions lower than the terminal accommodation chambers.

The tab is higher than the center of the terminal body. Thus, there is a concern that the tabs will interfere with upper parts of the lips in the process of mounting the male terminal fitting into the terminal accommodation chamber.

However, the through hole is lower than the terminal accommodation chamber. Therefore, the terminal body and the tab are lower than when the terminal body is accommodated in the terminal accommodation chamber, thereby avoiding interference of the tab with the lips and preventing improper deformation of the lips due to interference of the tab.

The lips may be formed such that a center of a minimum inner diameter portion of the lip located on a rear end may be lower than a center of a minimum inner diameter portion of the lip located on a front end. According to this configuration, the front part of the wire is fixed to the connecting portion in the terminal accommodation chamber, whereas an area of the wire inserted through the through hole is lower than the terminal accommodation chamber. Thus, the wire is inclined down to the rear in the seal hole. The center of the minimum inner diameter portion of the lip located on the rear end is lower than the center of the minimum inner diameter portion of the lip located on the front. Thus, all of the lips can be held in close contact with the wire over the entire circumference in this way, and sealing is excellent.

An outer peripheral surface of the one-piece rubber plug may be molded by a mold that is openable in the front-rear direction. An inner peripheral surface of the seal hole is molded by a core integrally provided to the mold. A virtual constant-diameter inner peripheral surface is formed by connecting maximum inner diameter portions on both front and rear ends of the lips in the front-rear direction, and an axis of the virtual constant-diameter inner peripheral surface is parallel to a mold opening direction of the mold.

In a vertical cross-section cut parallel to the mold opening direction of the mold. If the axis of the virtual constant-diameter inner peripheral surface is oblique to the mold opening direction, a height difference of an outer periphery of the core in a direction perpendicular to the mold opening direction becomes relatively large. Thus, resistance in removing the core increases. In contrast, if the axis of the virtual constant-diameter inner peripheral surface is parallel to the mold opening direction of the mold, the height difference of the outer periphery of the core in the direction perpendicular to the mold opening direction is relatively small. Thus, resistance in removing the core is reduced.

The virtual constant-diameter inner peripheral surface may be disposed at a position higher than a center position of the through hole in the height direction. According to this configuration, a height difference between a rear part of an area of the wire inclined down to the rear in the seal hole and a front end part of an area of the wire accommodated in the through hole is small. Thus, the wire need not be bent forcibly bent. This eliminates a large difference between an upward pressing force and a downward pressing force of the wire acting on the lip portions so that sealing is good.

DETAILED DESCRIPTION

An embodiment of the invention is described in detail with reference to FIGS. 1 to 7. In the following description, a left side in FIGS. 4 to 7 is defined as a front concerning a front-rear direction. Upper and lower sides shown in FIGS. 1 to 7 are defined as upper and lower sides concerning a vertical direction. A waterproof connector of this embodiment includes a housing 10 made of synthetic resin, male terminal fittings 20, a one-piece rubber plug and a rear holder 60.

Figure 6:
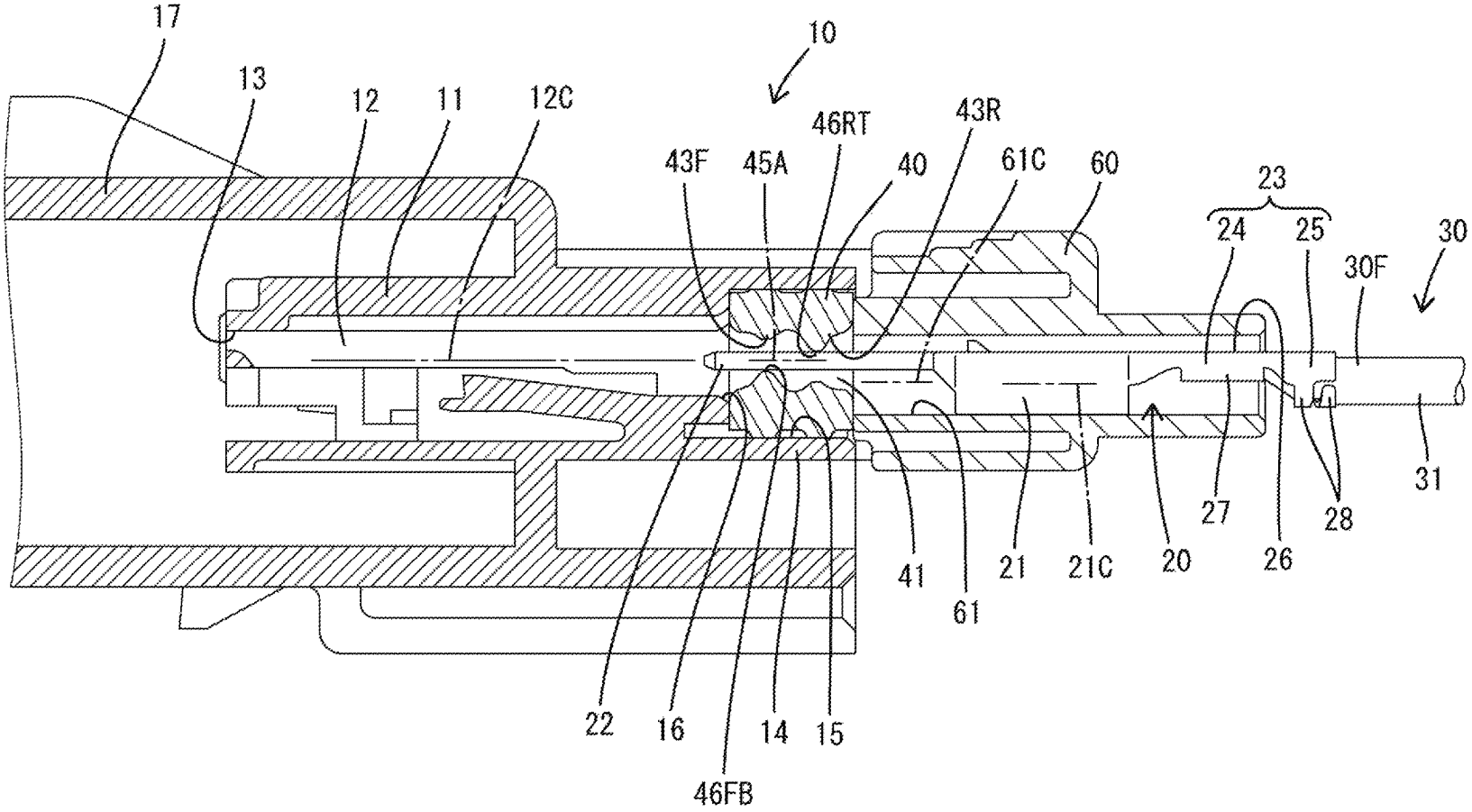
FIG. 6 is a side view in section showing the process of mounting a male terminal fitting into the housing.
Figure 7:
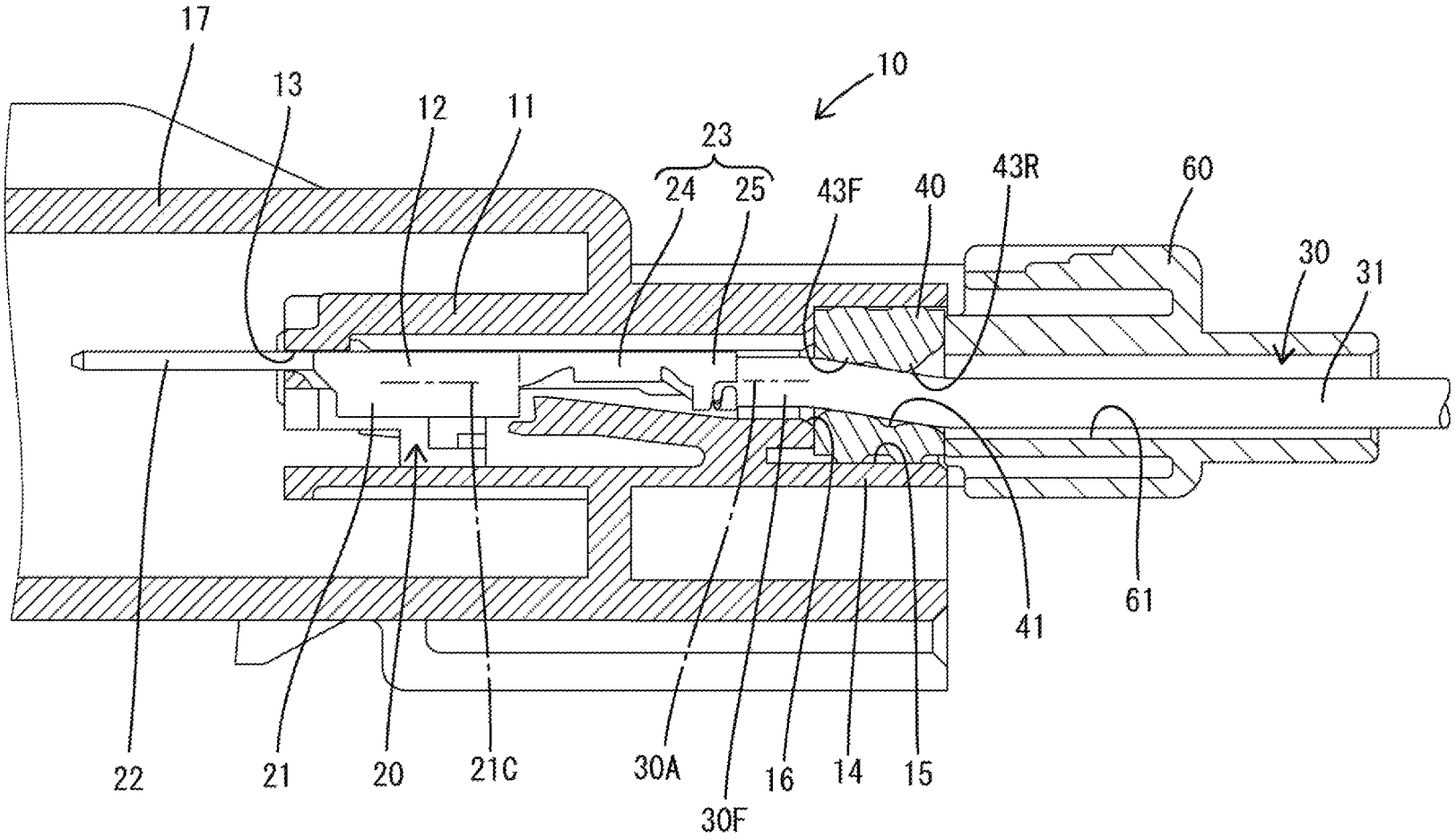
FIG. 7 is a side view in section showing a state where the male terminal fitting is mounted in the housing.

The housing 10 has a larger lateral dimension than a vertical dimension and includes, as shown in FIGS. 6 and 7, a terminal accommodating portion 11 and a rubber plug holding portion 14 connected to the rear end of the terminal accommodating portion 11. Terminal accommodation chambers 12 are formed side by side in a lateral direction in the terminal accommodating portion 11 and are long and narrow in the front-rear direction. A front end part of each terminal accommodation chamber 12 is open in the front end surface of the terminal accommodating portion 11 via a guide hole 13. The rubber plug holding portion 14 is formed with one accommodation recess 15 by recessing the rear end surface thereof substantially over the entire width. Rear end parts of all the terminal accommodation chambers 12 are open as terminal insertion openings 16 in the back end surface of the accommodation recess 15.

The male terminal fitting 20 is inserted into each terminal accommodation chamber 12 from behind the housing 10. As shown in FIGS. 6 and 7, the male terminal fitting 20 is long and narrow in the front-rear direction. Specifically, the male terminal fitting 20 includes a terminal body 21 in the form of a rectangular tube, a tab 22 cantilevered forward from the front end of the terminal body 21 and a connecting portion 23 in the form of an open barrel extending rearward from the rear end of the terminal body 21. A vertical dimension of the tab 22 is smaller than that of the terminal body 21. An upper surface part of the tab 22 is continuous and flush with an upper plate constituting the terminal body 21. Thus, the tab 22 is disposed at a position deviated up (in a direction perpendicular to an axis 30A of a front end part 30F of a wire 30 to be described later) from a vertical center position 21C of the terminal body 21.

The connecting portion 23 is composed of a wire barrel 24 in the form of an open barrel and an insulation barrel 25 in the form of an open barrel disposed behind and near the wire barrel 24. As shown in FIG. 6, the wire barrel 24 is composed of a base plate 26 flush with and extending rearward from the upper plate of the terminal body 21 and front crimping pieces 27 protruding down from both left and right sides of the base plate 26. The wire barrel 24 is conductively crimped to a conductor (not shown) exposed by removing an insulation coating 31 of the front end part 30F of the wire 30.

The insulation barrel 25 is composed of the base plate 26 and rear crimping pieces 28 protruding down from both left and right side edges of an area of the base plate 26 behind the front crimping pieces. The insulation barrel 25 is fixed to an area of the front end part 30F of the wire 30 where the conductor is covered with the insulation coating 31. The front end part 30F of the wire 30 connected to the connecting portion 23 is parallel to a length direction of the male terminal fitting 20 (front-rear direction). The axis 30A of the front end part 30F of the wire 30 is substantially at the same height as the vertical center position 21C of the terminal body 21 in a side view as shown in FIG. 7.

The male terminal fitting 20 connected to the front end part 30F of the wire 30 passes through the rear holder 60 and the one-piece rubber plug 40 from behind the rear holder 60 and is mounted into the housing 10. With the male terminal fitting 20 mounted in the housing 10, the terminal body 21, the connecting portion 23 and the front end part 30F of the wire 30 are accommodated in the terminal accommodation chamber 12 and the tab 22 projects forward of the terminal accommodating portion 11 through the guide hole 13 and is surrounded by the receptacle 17. With the male terminal fitting 20 mounted in the housing 10, the axis 30A of the front end part 30F of the wire 30 is located substantially at the same height as a vertical center position 12C of the terminal accommodation chamber 12 in the side view. The tab 22 is located above the axis 30A of the front end part 30F of the wire 30.

Figure 4:
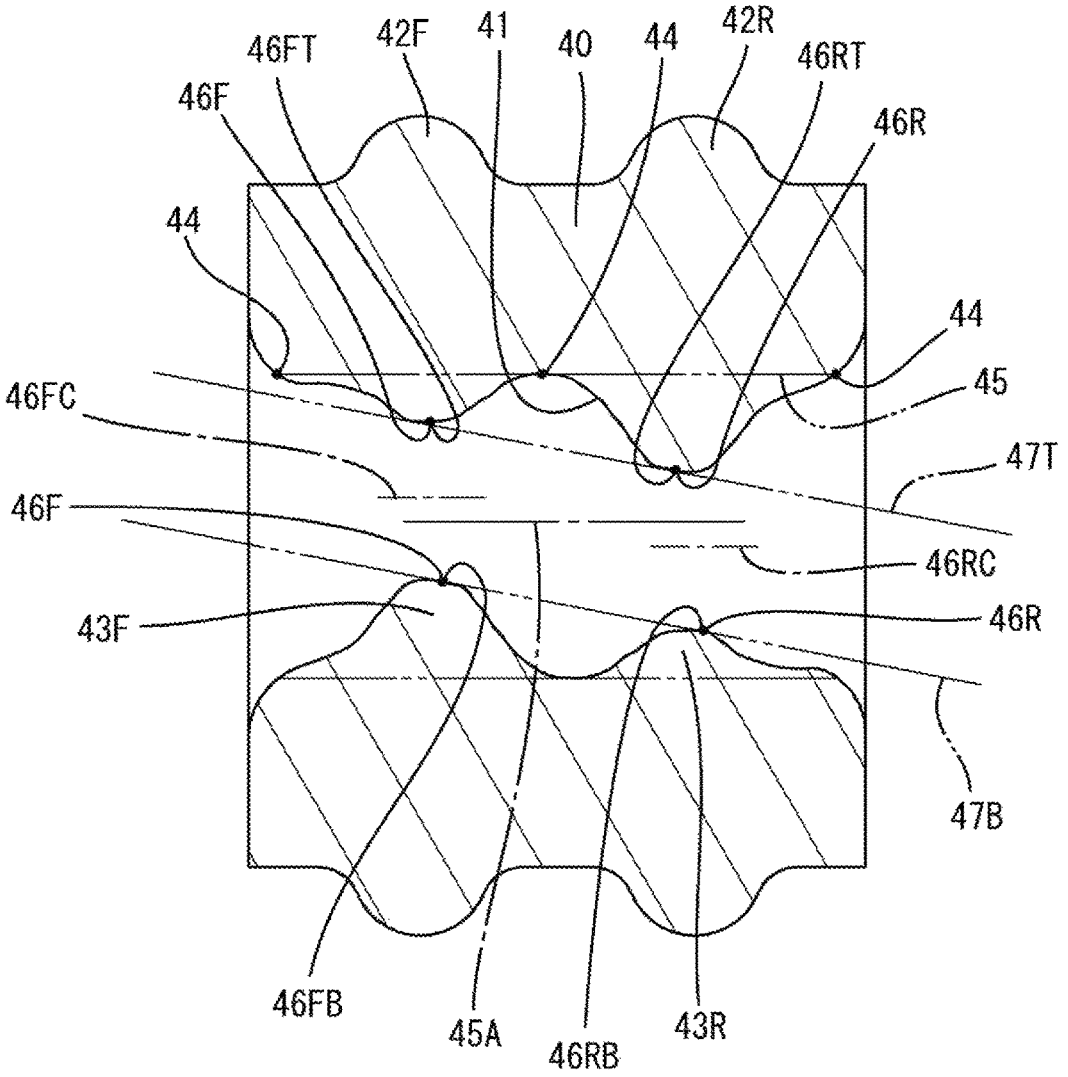
FIG. 4 is a section along X-X of FIG. 2.

The one-piece rubber plug 40 is accommodated in the accommodation recess 15. The one-piece rubber plug 40 is a block long in the lateral direction. Seal holes penetrate the one-piece rubber plug 40 from the front surface to the rear end surface thereof. Front end openings of the seal holes 41 individually correspond to the terminal insertion openings 16 of the terminal accommodation chambers 12 to substantially coaxially communicate with the terminal insertion openings 16. As shown in FIG. 4, front and rear outer peripheral lips 42F, 42R continuous over the entire circumference are formed integrally on the outer periphery of the one-piece rubber plug 40 while being spaced in the front-rear direction. The outer peripheral lips 42F, 42R seal a clearance between the outer periphery of the one-piece rubber plug 40 and the inner periphery of the accommodation recess 15 by being resiliently held in contact with the inner peripheral surface of the accommodation recess 15 in a liquid-tight manner.

Figure 5:
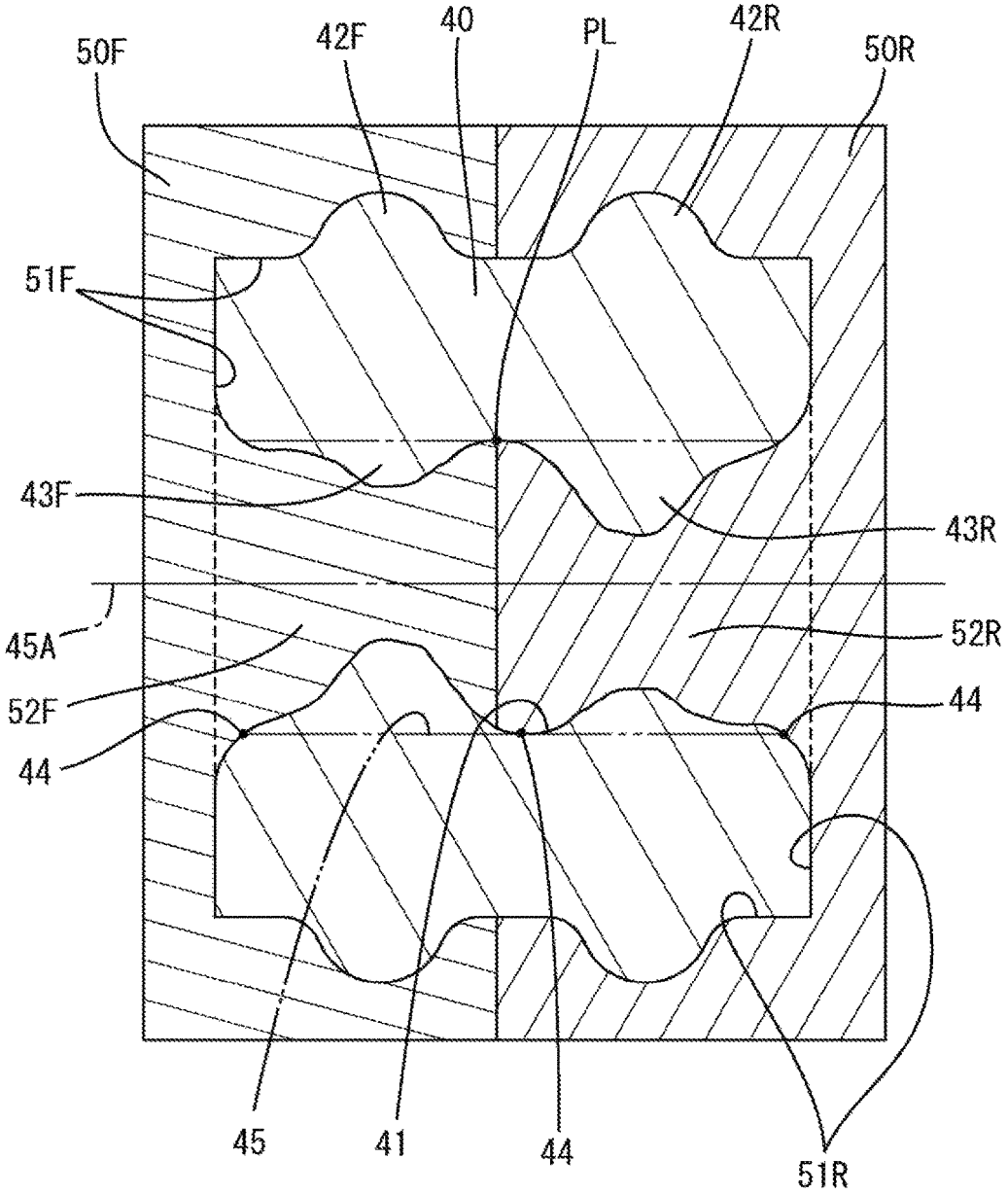
FIG. 5 is a section along X-X showing a manufacturing process of the rubber plug.

As shown in FIGS. 4 and 5, a front inner peripheral lip 43F and a rear inner peripheral lip 43R are formed on the inner periphery of each seal hole 41 while being spaced apart in the front-rear direction. Both of the front and rear inner peripheral lips 43F, 43R project like ribs along a circumferential direction and are continuous over the entire circumference. The front inner peripheral lip 43F is disposed substantially at the same position as the front outer peripheral lip 42F in the front-rear direction, and the rear inner peripheral lip 43R is disposed substantially at the same position as the rear outer peripheral lip 42R in the front-rear direction.

A virtual constant-diameter inner peripheral surface having a circular cross-section is set by connecting maximum inner diameter portions 44 on both front and rear ends of the front inner peripheral lip 43F and maximum inner diameter portions 44 on both front and rear ends of the rear inner peripheral lip 43R in the front-rear direction. An inner diameter dimension of the virtual constant-diameter inner peripheral surface 45 is constant over the entire length of the one-piece rubber plug 40 (seal hole 41). The front and rear inner peripheral lips 43F, 43R project radially inward like ribs from the virtual constant-diameter inner peripheral surface 45. An axis 45A of the virtual constant-diameter inner peripheral surface 45 is oriented in the front-rear direction and is at substantially the same height as the axis 30A of the front end part 30 of the wire 30 (i.e. substantially at the same height as the vertical center position of the terminal accommodation chamber 12) or at a position slightly lower than the axis 30A of the front end part 30F of the wire 30.

Figure 1:
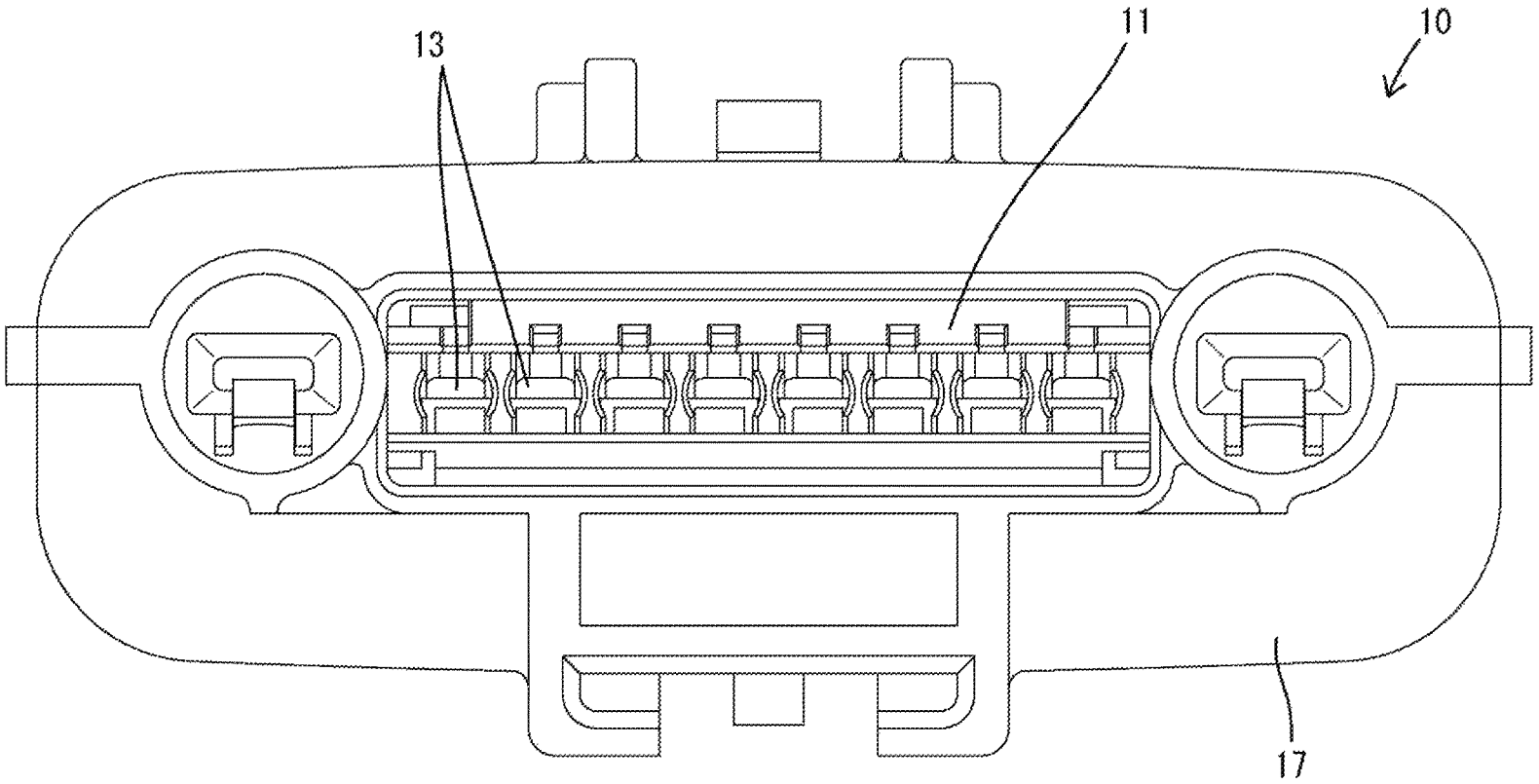
FIG. 1 is a front view of a housing constituting a waterproof connector of one embodiment.
Figure 2:
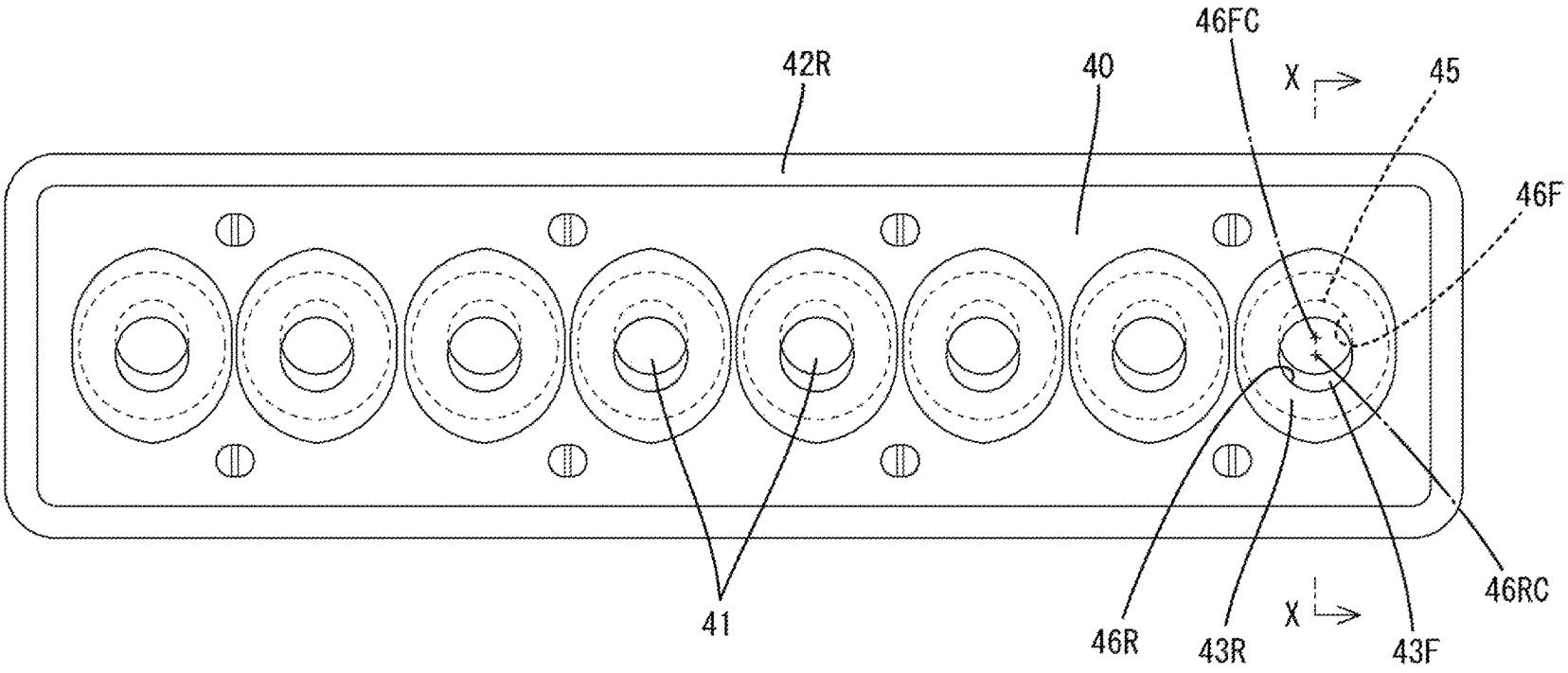
FIG. 2 is a back view of a one-piece rubber plug.
Figure 3:
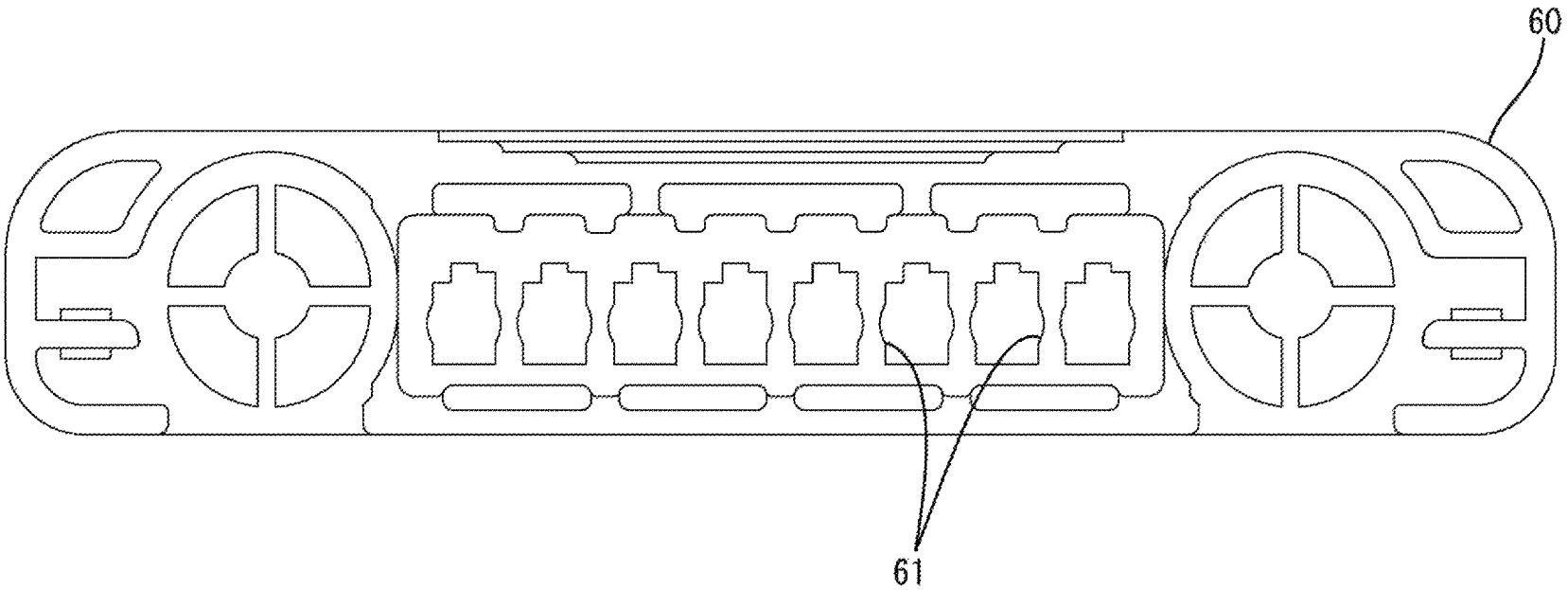
FIG. 3 is a front view of a rear holder.

As shown in FIG. 2, in a back view parallel to the axis 45A of the virtual constant-diameter inner peripheral surface 45, a minimum inner diameter portion 46F of the front inner peripheral lip 43F and a minimum inner diameter portion 46R of the rear inner peripheral lip portion 43R form circles having an equal inner diameter. Inner diameters of the minimum inner diameter portion 46F of the front inner peripheral lip 43F and the minimum inner diameter portion 46R of the rear inner peripheral lip 43R are smaller than an outer diameter dimension of the wire 30. The front and rear inner peripheral lips 43F, 43R are held in close contact with the outer periphery of the insulation coating 31 of the wire 30 in a liquid-tight manner while being resiliently deformed over the entire circumference.

As shown in FIG. 4, a center 46FC of the minimum inner diameter portion 46F of the front inner peripheral lip portion 43F is deviated up from the axis 45A of the virtual constant-diameter inner peripheral surface 45. A center 46RC of the minimum inner diameter portion 46R of the rear inner peripheral lip 43R is, contrary to the front inner peripheral lip portion 43F, deviated down from the axis 45A of the virtual constant-diameter inner peripheral surface 45 and a deviation amount thereof is equal to that of the front inner peripheral lip 43F. Thus, a virtual upper end connecting line 47T connecting an upper end 46FT of the minimum inner diameter portion 46F of the front inner peripheral lip 43F and an upper end 46RT of the minimum inner diameter portion 46R of the rear inner peripheral lip 43R is inclined down toward the rear. Similarly, a virtual lower end connecting line 47B connecting a lower end 46FB of the minimum inner diameter portion 46F of the front inner peripheral lip 43F and a lower end 46FB of the minimum inner diameter portion 46R of the rear inner peripheral lip 43R also is inclined down toward the rear.

With the male terminal fitting 20 mounted in the housing 10, the area of the wire 30 covered with the insulation coating 31 is inserted through the seal hole 41. The front and rear inner peripheral lips 43F, 43R are held in close contact with the outer periphery of the insulation coating 31 in a liquid-tight manner over the entire circumference while being resiliently deformed. Further, the downward inclination of the virtual upper end connecting line and the virtual lower end connecting line toward the rear (toward the rear holder 60) ensure that the wire 30 also obliquely penetrates through the seal hole 41.

As shown in FIG. 5, the one-piece rubber plug 40 is molded by front and rear molds 50F, 50R that are opened in the front-rear direction. The front mold 50F includes a front molding recess 51F and a front core 52F. The front molding recess 51F molds a front area of the outer peripheral surface of the one-piece rubber plug 40 including the front outer peripheral lip 42F and the front end surface of the one-piece rubber plug 40. The front core 52F molds the entire front inner peripheral lip 43F.

The rear mold 50R includes a rear molding recess 51R and a rear core 52R. The rear molding recess 51R molds a rear area of the outer peripheral surface of the one-piece rubber plug 40 including the rear outer peripheral lip 42R and the rear end surface of the one-piece rubber plug 40. The rear core 52R molds the entire rear inner peripheral lip 43R. A parting line PL is formed at a position where the front end surface of the rear core 52R and the rear end surface of the front core 52F are held in surface contact. This parting line PL is at a middle position between the front and rear inner peripheral lips 43F, 43R (area where the seal hole 41 is not resiliently in contact with the wire 30) and does not adversely affect sealing ability of the front and rear inner peripheral lips 43F, 43R.

At the time of mold opening, the front inner peripheral lip 43F is deformed resiliently to expand radially out by a rear projecting end part of the front core 52F and the rear inner peripheral lip 43R is deformed resiliently to expand radially out by a front projecting end part of the rear core 52R. Accordingly, the axis 45A of the virtual constant-diameter inner peripheral surface 45 connecting the maximum inner diameter portions 44 of the front inner peripheral lip 43F and the maximum inner diameter portions 44 of the rear inner peripheral lip 43R is parallel to a mold opening direction of the molds 50F, 50R.

In this way, the front and rear inner peripheral lips 43F, 43R are deformed resiliently radially out by as much as the front and rear inner peripheral lips 43F, 43R project from the virtual constant-diameter inner peripheral surface 45. Thus, the amounts of radially outward resilient deformation of the front and rear inner peripheral lips 43F, 43R can be reduced as compared to the case where the axis 45A of the virtual constant-diameter inner peripheral surface 45 is oblique to the mold opening direction of the molds 50F, 50R.

The rear holder 60 is made of synthetic resin and in the form of a block long in the lateral direction. The rear holder 60 is mounted into the housing 10 to contact the rear surface of the one-piece rubber plug 40 and restricts the one-piece rubber plug 40 from being separated rearward and relatively displaced from the housing 10. Through holes 61 penetrate the rear holder 60 in the front-rear direction. The front ends of the through holes 61 individually communicate with and correspond to the rear end openings of the seal holes 41.

As shown in FIG. 6, the through hole 61 is disposed at a position deviated down (in a direction perpendicular to the axis 30A of the front part 30F of the wire 30) to be lower than the terminal accommodation chamber 12 in a side view. Specifically, a vertical center 61C of the through hole 61 is below the vertical center 12C of the terminal accommodation chamber 12 and is below the axis 45A of the virtual constant-diameter inner peripheral surface 45. A direction of deviation of the through hole 61 from the terminal accommodation chamber 12 is vertically opposite to a direction of deviation of the tab 22 from the vertical center 21C of the terminal body 21 and the axis 30A of the front end part 30F of the wire 30.

The male terminal fitting 20 is mounted into the housing 10 by inserting the tab 22 into the through hole 61 from behind the rear holder 60 with the tab 22. Sufficient insertion causes the terminal body 21 to be accommodated in the through hole 61 as shown in FIG. 6. Thus, the tab 22 is inserted between the upper end 46RT of the minimum inner diameter portion 46R of the rear inner peripheral lip 43R and the lower end 46FB of the minimum inner diameter portion 46F of the front inner peripheral lip 43F. The tab 22 is at the position higher than the vertical center 21C of the terminal body 21, but the through hole 61 in which the terminal body 21 is at the position lower than the axis 45A of the virtual constant-diameter inner peripheral surface 45. Thus, the tab 22 does not interfere with the rear inner peripheral lip 43R.

When the male terminal fitting 20 is inserted farther from the state shown in FIG. 6, the tab 22 passes through the seal hole 41 and enters the terminal accommodation chamber 12 and the terminal body portion 21 and the connecting portion 23 pass through the seal hole 41 while resiliently deforming the rear and front inner peripheral lips 43R, 43F. When the male terminal fitting 20 is mounted properly, the wire 30 is passed through the seal hole 41 while resiliently deforming the rear and front inner peripheral lips 43R, 43F to expand these inner peripheral lips 43R, 43F radially out, as shown in FIG. 7.

Since the virtual upper end connecting line 47T and the virtual lower end connecting line 47B are inclined downwardly to the rear in this state, the wire 30 in the seal hole 41 is also inclined downwardly to the rear. Since the rear end opening of the seal hole 41 is substantially at the same height as the through hole 61, an area of the wire 30 from the seal hole 41 to the through hole 61 is not forcibly bent. Further, since the front end opening of the seal hole 41 is substantially at the same height as the terminal accommodation chamber 12, an area of the wire 30 from the seal hole 41 to the terminal accommodation chamber 12 is also not forcibly bent.

The waterproof connector of this embodiment includes the male terminal fittings 20, the housing 10, the one-piece rubber plug 40 and the rear holder 60. The male terminal fitting 20 is long in the front-rear direction and includes the connecting portion 23 connected to the rear end of the terminal body 21. The connecting portion 23 is fixed to the front end part 30F of the wire 30 so that the terminal body 21 is substantially coaxial with the front end part 30F. The male terminal fitting 20 is formed with the long and narrow tab 22 extending forward from the terminal body 21, and the tab 22 is higher than the center of the terminal body 21.

The housing 10 has the terminal accommodation chambers 12 for accommodating the terminal bodies 21 and the connecting portions 23. The one-piece rubber plug 40 is provided in the rear end part of the housing 10 and formed with the seal holes 41 communicating with the terminal accommodation chambers 12. The rear holder 60 is behind the one-piece rubber plug 40 and formed with the through holes 61 communicating with the seal holes 41.

With the terminal body 21 and the front end part 30F of the wire 30 accommodated in the terminal accommodation chamber 12, the front and rear inner peripheral lips 43F, 43R formed on the inner periphery of the seal hole 41 are in close contact with the outer periphery of the wire 30 in a liquid-tight manner. The through hole 61 is disposed at the position relatively lower than the terminal accommodation chamber 12.

In the process of mounting the male terminal fitting 20 into the terminal accommodation chamber 12, the tab 22 is in the seal hole 41 if the terminal body 21 is in the through hole 61. The tab 22 is higher than the vertical center 21C of the terminal body 21. Thus, there is a concern for the interference of the tab 22 with upper surface side parts of the lips. However, the through hole 61 is lower than the terminal accommodation chamber 12. Thus, the positions of the terminal body 21 and the tab 22 are lower than those in a state where the terminal body 21 is accommodated in the terminal accommodation chamber 12. The tab 22 is not likely to interfere with the lips. Thus, the lips are not likely to be deformed by the interference of the tab 22.

Further, the front end part 30F of the wire 30 is fixed to the connecting portion 23 in the terminal accommodation chamber 12, whereas the area of the wire 30 inserted through the through hole 61 is lower than the terminal accommodation chamber 12. Thus, the wire 30 is inclined down to the rear in the seal hole 41. In view of this point, the center 46RC of the minimum inner diameter portion 46R of the rear inner peripheral lip 43R is lower than the center 46FC of the minimum inner diameter portion 46F of the front inner peripheral lip 43F located before the rear inner peripheral lip 43R. Sealing is excellent since all of the lips 43F, 43R can be held in close contact with the wire 30 over the entire circumference in this way.

Further, the outer peripheral surface of the one-piece rubber plug 40 is molded by the front and rear molds 50F, 50R that are opened in the front-rear direction. The inner peripheral surface of the seal hole 41 is molded by the front core 52F integrally provided to the front mold 50F and the rear core 50R integrally provided to the rear mold 50R. Assuming the virtual constant-diameter inner peripheral surface 45 formed by connecting the maximum inner diameter portions 44 on both front and rear ends of the front inner peripheral lip 43F and the maximum inner diameter portions 44 on both front and rear ends of the rear inner peripheral lip 43R in the front-rear direction, the axis 45A of this virtual constant-diameter inner peripheral surface 45 is parallel to the mold opening direction of the front and rear molds 50F, 50R.

In a vertical cross-section cut in parallel to the mold opening direction of the molds 50F, 50R, if the axis of the virtual constant-diameter inner peripheral surface 45 is oblique to the mold opening direction (front-rear direction) of the molds 50F, 50R, height differences of the outer peripheries of the cores 52F, 52R in a direction perpendicular to the mold opening direction become relatively large. Thus, resistance in removing the cores 52F, 52R increases.

In contrast, the axis 45A of the virtual constant-diameter inner peripheral surface 45 is parallel to the mold opening direction of the molds 50F, 50R. Thus, the height differences of the outer peripheries of the cores 52F, 52R in the direction perpendicular to the mold opening direction are relatively small. Thus, resistance in removing the cores 52F, 52R while resiliently deforming the front and rear inner peripheral lips 43R, 43R radially outward is reduced.

Further, the axis 45A of the virtual constant-diameter inner peripheral surface 45 is at the position higher than the vertical center position 61C of the through hole 61. According to this configuration, a height difference between a rear end part of the area of the wire 30 inclined down to the rear in the seal hole 41 and a front end part of the area of the wire 30 accommodated in the through hole 61 is small. Thus, the wire 30 needs not be forcibly bent. Since this eliminates a large difference between an upward pressing force and a downward pressing force of the wire 30 acting on the inner peripheral lip portions 43F, 43R, good sealability is exhibited.

The invention is not limited to the above described embodiment. For example, the following embodiments also are included in the scope of the invention.

Although the center of the minimum inner diameter portion of the rear inner peripheral lip located on the rear side is lower than the center of the minimum inner diameter portion of the front inner peripheral lip located on the front side in the above embodiment, the center of the minimum inner diameter portion of the rear inner peripheral lip and the center of the minimum inner diameter portion of the front inner peripheral lip may be at the same height.

Although only two lips are provided in the above embodiment, three or more lips may be provided.

Although the axis of the virtual constant-diameter inner peripheral surface formed by connecting the maximum inner diameter portions on both front and rear ends of the lips, out of the inner peripheral surface of the seal hole, in the front-rear direction is parallel to the mold opening direction of the molds in the above embodiment, the axis of the virtual constant-diameter inner peripheral surface may be oblique to the mold opening direction.

Although the axis of the virtual constant-diameter inner peripheral surface is at the position higher than the center of the through hole in the height direction in the above embodiment, the axis of the virtual constant-diameter inner peripheral surface may be at the same height as the center position of the through hole in the height direction.

Although the axis of the virtual constant-diameter inner peripheral surface is substantially at the same height as the axis of the front end part of the wire in the terminal accommodation chamber in the above embodiment, the height of the axis of the virtual constant-diameter inner peripheral surface may be lower than that of the axis of the front end part of the wire in the terminal accommodation chamber.

LIST OF REFERENCE SIGNS

10 . . . housing
12 . . . terminal accommodation chamber
20 . . . male terminal fitting
21 . . . terminal body
21C . . . center position of terminal body portion in height direction
22 . . . tab
23 . . . connecting portion
30 . . . wire
30F . . . front end part of wire
40 . . . one-piece rubber plug
41 . . . seal hole
43F . . . front inner peripheral lip (lip)
43R . . . rear inner peripheral lip (lip)
44 . . . maximum inner diameter portions of front and rear inner peripheral lips
45 . . . virtual constant-diameter inner peripheral surface
45A . . . axis of virtual constant-diameter inner peripheral surface
46F . . . minimum inner diameter portion of front inner peripheral lip
46FC . . . center of minimum inner diameter portion of front inner peripheral lip
46R minimum inner diameter portion of rear inner peripheral lip
46RC . . . center of minimum inner diameter portion of rear inner peripheral lip
50F . . . front mold (mold)
50R . . . rear mold (mold)
52F . . . front core (core)
52R . . . rear core (core)
60 . . . rear holder
61 . . . through hole
61C . . . center position of through hole in height direction

What is claimed is:

1. A waterproof connector, comprising:

male terminal fittings each shaped to extend long in a front-rear direction and including a connecting portion connected to a rear end of a terminal body, the connecting portion being fixed to a front end part of a wire such that the terminal body is substantially coaxial with the front end part;

long and narrow tabs each extending forward from the terminal body and disposed with its center position higher than a center position of the terminal body in a height direction;

a housing formed with terminal accommodation chambers for accommodating the terminal bodies and the connecting portions;

a one-piece rubber plug provided in a rear part of the housing and formed with seal holes communicating with the terminal accommodation chambers; and a rear holder disposed behind the one-piece rubber plug and formed with through holes communicating with the seal holes, wherein:

lips formed on an inner periphery of the seal hole are held in close contact with an outer periphery of the wire in a liquid-tight manner with the terminal body and the front end part of the wire accommodated in the terminal accommodation chamber; and the axes of through holes are disposed at positions lower than the axes of terminal accommodation chambers.

2. The waterproof connector of claim 1, wherein:

the lips are formed such that a center of a minimum inner diameter portion of the lip located on a rear end is lower than a center of a minimum inner diameter portion of the lip located on a front end.

3. The waterproof connector of claim 2, wherein:

an outer peripheral surface of the one-piece rubber plug is molded by a mold openable in the front-rear direction;

an inner peripheral surface of the seal hole is molded by a core integrally provided to the mold; and when a virtual constant-diameter inner peripheral surface formed by connecting maximum inner diameter portions on both front and rear ends of the lips, out of the inner peripheral surface of the seal hole, in the front-rear direction is assumed, an axis of the virtual constant-diameter inner peripheral surface is parallel to a mold opening direction of the mold.

4. The waterproof connector of claim 3, wherein the axis of the virtual constant-diameter inner peripheral surface is disposed at a position higher than a center position of the through hole in the height direction.

* * * * *